US007316277B2

(12) United States Patent
Jeffryes

(10) Patent No.: US 7,316,277 B2
(45) Date of Patent: Jan. 8, 2008

(54) BOTTOM HOLE ASSEMBLY

(75) Inventor: Benjamin Peter Jeffryes, Histon (GB)

(73) Assignee: Schlumberger Technology Corporation, Ridgefield, CT (US)

( * ) Notice: Subject to any disclaimer, the term of this patent is extended or adjusted under 35 U.S.C. 154(b) by 194 days.

(21) Appl. No.: 11/085,335

(22) Filed: Mar. 21, 2005

(65) Prior Publication Data

US 2005/0211470 A1 Sep. 29, 2005

(30) Foreign Application Priority Data

Mar. 27, 2004 (GB) ..... 0406921.7

(51) Int. Cl.
*E21B 10/26* (2006.01)
*E21B 44/00* (2006.01)

(52) U.S. Cl. ..... 175/27; 175/385; 175/406

(58) Field of Classification Search ..... 175/385, 175/344, 406, 27

See application file for complete search history.

(56) References Cited

U.S. PATENT DOCUMENTS

| | | | | |
|---|---|---|---|---|
| 1,803,669 | A * | 5/1931 | Grant | 175/273 |
| 1,819,358 | A * | 8/1931 | Crum | 175/283 |
| 3,712,854 | A | 1/1973 | Thometz et al. | |
| 4,589,504 | A | 5/1986 | Simpson | |
| 4,792,000 | A | 12/1988 | Perkin et al. | |
| 4,843,875 | A | 7/1989 | Kerbart | |
| 5,343,964 | A | 9/1994 | Leroy | |
| 5,386,724 | A | 2/1995 | Das et al. | |
| 5,476,148 | A | 12/1995 | LaBonte | |
| 6,378,632 | B1 | 4/2002 | Dewey et al. | |
| 6,615,933 | B1 | 9/2003 | Eddison | |
| 6,684,949 | B1 | 2/2004 | Gabler et al. | |
| 6,705,413 | B1 | 3/2004 | Tessari | |
| 2004/0104051 | A1 * | 6/2004 | Moriarty et al. | 175/57 |

FOREIGN PATENT DOCUMENTS

| | | |
|---|---|---|
| CA | 2 147 063 A1 | 10/1996 |
| CA | 2 171 178 C | 4/2001 |
| EP | 0 640 743 A2 | 3/1995 |
| EP | 0 640 743 A3 | 3/1995 |
| GB | 265 507 | 2/1927 |
| GB | 1 111 256 | 4/1968 |

* cited by examiner

*Primary Examiner*—David Bagnell
*Assistant Examiner*—Giovanna M Collins
(74) *Attorney, Agent, or Firm*—Vincent Loccisano; Jody Lynn DeStefanis; Steven Gahlings

(57) ABSTRACT

A bottom hole assembly has a drill bit and an under-reamer on the up-hole side of the drill bit. In one aspect, the assembly further has a compliant element linking the drill bit to the under-reamer, the compliant element allowing displacement of the drill bit relative to the under-reamer in the axial direction of the assembly. In another aspect, the assembly further has a sensor element which is arranged to measure the weight-on-bit and/or the applied torque of the drill bit, and a transmitter for transmitting the weight-on-bit and/or applied torque measurements to the surface.

11 Claims, 1 Drawing Sheet

BOTTOM HOLE ASSEMBLY

The present invention relates to a bottom hole assembly (BHA) having a drill bit and an under-reamer on the up-hole side of the drill bit.

BACKGROUND OF THE INVENTION

In drilling operations, such as the drilling of hydrocarbon wells, drilled bores are usually lined with steel tubing known as casing, which is cemented in place by pumping cement into an annulus between the casing and the bore wall. Once a length of casing is in place, this imposes a restriction on the diameter of any subsequent section of bore, as the drill bit and any further casing must pass through the existing casing. However, reductions in bore diameter are undesirable as they tend to limit the production flow rate of hydrocarbons through the bore. Thus under-reamers are used to enlarge such subsequent sections of bore. Examples of under-reamers are disclosed in U.S. Pat. Nos. 6,378,632, 6,615,933, 4,589,504 and 3,712,854. Generally an under-reamer is used in a BHA up-hole of a drill bit. In this way the drill bit drills the borehole to be under-reamed at the same time that the under-reamer enlarges the borehole formed by the bit.

However, a problem with BHAs of this type is that if the under-reamer drills material which is much harder than that being drilled by the bit, excessive weight can be applied to the under-reamer. This can lead to premature wear and cutter damage. Also, in some circumstances, the opposite problem may occur, i.e. when the bit drills material much harder than that being drilled by the under-reamer, excessive weight can be applied to the bit.

Another problem is that as the material being drilled by the bit and under-reamer changes in hardness, the weight and torque can be transferred very rapidly between the two, leading to axial and rotational shocks. These shocks may be damaging to down-hole equipment.

In U.S. Pat. No. 5,343,964 a downhole tools is described where a central drill bit is connected with a coaxial drill bit. The central drill bit is driven by a downhole motor, and a circumferential drill bit is driven by drillstring rotation from the surface. The two bits are connected by an axial spring above the downhole motor and a prismatic connection below the motor that connects the stator of the downhole motor to the drillstring.

The most common need for a circumferential bit in well construction is to under-ream a hole to a size larger than the casing above the newly created hole. This necessitates a so-called 'on-demand' under-reamer, where the cutting elements are extended outward to their full diameter when required (normally after the under-reamer has cleared the casing shoe). The apparatus described in '964, is difficult to adapt to a use with an on-demand under-reamer, as the radial arrangement of central bit drive shaft, prismatic element and circumferential bit does not have the space to accommodate the under-reamer in its retracted position. Additionally one of the standard methods for under-reamer deployment, the use of a ball drop, would be impossible with the configuration as described.

It is therefore an object of the invention to provide an improved tool with applications in a wide range of under-reamer operations.

SUMMARY OF THE INVENTION

In a first aspect, the present invention addresses these problems by providing a compliant element between the under-reamer and the drill bit. The compliant element is thus located below the under-reamer. The element can smooth out the transition from one under-reamer/drill bit force distribution to another force distribution, and preferably permits better weight control by either a human or an automated driller.

Thus, the present invention provides in this aspect a bottom hole assembly having a drill bit and an under-reamer on the up-hole side of the drill bit, the assembly further having a compliant element located at the down-hole side of the under-reamer so as to link the drill bit to the under-reamer, the compliant element allowing displacement of the drill bit relative to the under-reamer in the axial direction of the assembly. All sections or parts of the drill string which provide a force-coupling connection between the under-reamer section and the drill bit section are located above the compliant element. The compliant element while allowing for axial relative movement is preferably of a type that can transfer torsional or rotational force without being significantly more twisted than other parts of the drill string when rotated.

The compliant element and thus the force-coupling connection above it are preferably located up-hole from a steerable system used to control the drilling direction. These steerable systems are preferable devices for rotary steerable operations. The invention thus overcomes a major disadvantage present in the system as described in U.S. Pat. No. 5,343,964, which is not suitable for rotary steerable applications.

The novel arrangement further allows to accommodate measuring subs within the drill bit section of the drill string. Such measuring subs are located below the under-reamer and the drill bit and, as all sections of the drill string below the force-coupling connection to the under-reamer, exposed directly to the wellbore environment.

Advantageously, the compliant element can reduce shock-loads on the under-reamer. Furthermore, if the under-reamer or drill bit encounters harder material, it can increase the time before the under-reamer or drill bit is damaged or excessively worn by the encounter, thereby providing the driller with an opportunity to take avoiding or mitigating action.

Preferably the compliant element is adapted to allow at least 10 cm of relative displacement, and more preferably at least 20 or 50 cm of relative displacement. Preferably the compliant element has a compliance in the range 0.5 to 10 μm/Newton, and more preferably in the range 2 to 5 μm/Newton.

Typically, the compliant element is biased towards a fully extended position which produces a maximum axial spacing between the drill bit and the under-reamer. For example, the compliant element may comprise a spring to generate the bias.

In normal use down-hole, however, most of the weight is on the drill bit, which shortens the compliant element to a significant extent. When the under-reamer encounters harder material, the weight on the drill bit decreases and the compliant element extends under the influence of the bias. On the other hand, if most of the weight is initially on the under-reamer, the compliant element will extend significantly. Then, when the drill bit encounters harder material, weight which was on the under-reamer transfers to the drill-bit and the compliant element shortens against the influence of the bias.

Typically, the compliant element has a stroke length which defines the maximum axial spacing and a minimum axial spacing that can be produced, by the relative displacement, between the drill bit and the under-reamer.

In general, the stroke length and the compliance of the compliant element are selected so that when substantially all the weight is on the drill bit, the compliant element is shortened so that only about 20% to 5% (preferably about 15% to 10%) of the stroke length remains to bring the drill bit and under-reamer closer together. The further small amount of shortening that the compliant element can undergo provides a "cushion" in case additional weight is applied to the drill bit. Clearly, the choice of stroke length and compliance will be determined by the weight which the driller intends to apply to the drill bit.

The bottom hole assembly may be rotary-steerable. Some such assemblies have thrust members or pads (see e.g. U.S. Pat. No. 6,705,413) which press against the borehole wall and which are particularly vulnerable to shear wave oscillations in the drillstring. Other forms of rotary-steerable system generate a bit deviation without pads contacting the borehole wall, but can also be damaged by back-rotation and excessive rotation speed—both of which can be associated with high levels of bottom hole assembly shear vibration. The shear wave oscillations may be caused by the time lag between a torque increase at the under-reamer when the under-reamer encounters harder material, and the responding torque increase applied by the surface drive system. By providing the compliant element between the drill bit and the under-reamer, such oscillations can be avoided or reduced.

In preferred embodiments, the bottom hole assembly further has a sensor element which is arranged to measure the weight-on-bit and/or the applied torque of the drill bit, and a transmitter for transmitting the weight-on-bit and/or applied torque measurements to the surface. In principle, surface measurements can provide a driller with preliminary indications as to whether the under-reamer has encountered harder material. However, down-hole measurements provided by the sensor element can confirm these preliminary indications and also provide more accurate measurements of the under-reamer/drill bit force distribution.

However, particularly if the down-hole measurements can be made available effectively instantaneously and at a high rate to the driller, e.g. by running electrical or optical cabling along the drill string from the transmitter or by some other means of providing a closed electrical or optical path within the borehole, the measurements can provide a real-time indication of when the under-reamer or drill bit encounters harder material, allowing the driller to take avoiding or mitigating action. Such methods will be referred to subsequently as "high speed telemetry".

Thus in a second aspect, the present invention provides a bottom hole assembly having a drill bit and an under-reamer on the up-hole side of the drill bit, the assembly further having a sensor element which is arranged to measure the weight-on-bit and/or the applied torque of the drill bit, and a transmitter for transmitting the weight-on-bit and/or applied torque measurements to the surface.

Preferably, the transmitter transmits the measurements by high speed telemetry.

Although the bottom hole assembly of this aspect may not have a compliant element linking the drill bit to the under-reamer, it can still be used by the driller to prevent premature cutter wear or damage.

Further aspects of the invention relate to methods of controlling under-reaming drilling operations using bottom hole assemblies as described above.

Thus in another aspect, the present invention provides a method of controlling an under-reaming drilling operation, comprising the steps of:

- drilling a well with the bottom hole assembly of the first aspect;
- monitoring the surface torque applied to the drill string; and
- controlling the drilling operation to avoid overloading the under-reamer or drill bit when the surface torque indicates that weight is transferring between the drill bit and the under-reamer.

Preferably, the method further comprises the steps of:

- monitoring the surface hookload, and correlating the surface hookload with the surface torque;
- the drilling operation being controlled to avoid overloading the under-reamer or drill bit when the correlation of the surface hookload with the surface torque indicates that weight is transferring between the drill bit and the under-reamer.

In a further aspect, the present invention provides a method of controlling an under-reaming drilling operation, comprising the steps of:

- drilling a well with the bottom hole assembly of preferred embodiments of the first aspect which have the sensor element and the transmitter, or drilling the well with the bottom hole assembly of the second aspect;
- measuring the weight-on-bit and/or the applied torque of the drill bit using the sensor element; and
- controlling the drilling operation to avoid overloading the under-reamer or drill bit when the measured weight-on-bit and/or applied torque indicates that weight is transferring between the drill bit and the under-reamer.

In a further aspect, the present method provides a method of controlling an under-reaming drilling operation, comprising the steps of:

- drilling a well with the bottom hole assembly of the first aspect;
- monitoring the apparent compliance of the drillstring using surface measurements;
- inferring from the apparent compliance the equilibrium weight ratio between the under-reamer and the drill bit; and
- controlling the drilling operation to avoid overloading the under-reamer or drill bit when the weight ratio indicates that weight is transferring between the drill bit and the under-reamer.

In a further aspect, the present method provides a method of monitoring cutting constants during an under-reaming drilling operation, the method comprising the steps of:

- drilling a well with the bottom hole assembly of the first aspect;
- performing a drill-off test and measuring the hookload against time during the test;
- inferring from the measured hookload against time the cutting constants of the drill bit and the under-reamer.

In further aspect of the invention, there is provided a bottom hole assembly having a drill bit and an under-reamer on the up-hole side of the drill bit,

- the assembly further having an element responsive to a weight distribution between a weight on the drill bit and a weight on the under-reamer. The responsive element may include a compliant element or a sensor adapted to sense the weight on at least on of drill bit or under-reamer.

BRIEF DESCRIPTION OF THE DRAWINGS

The present invention will now be described in relation to specific embodiments and with reference to the following FIGURE in which.

EXAMPLES

Theoretical Considerations

Figure 1:
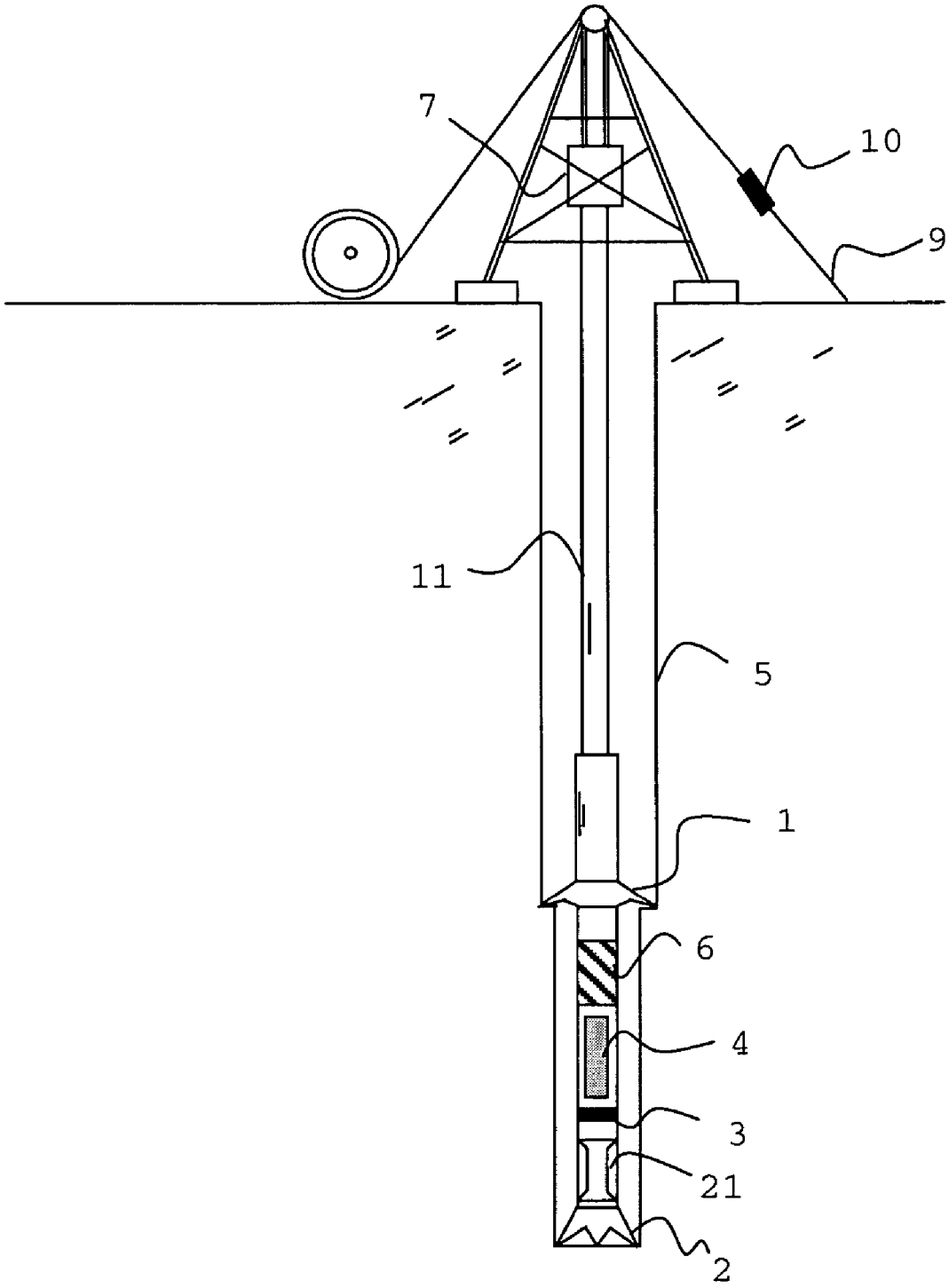
FIG. 1 shows schematically an apparatus for drilling a bore hole.

The weight-on-bit and bit velocity of a drill bit can be related by the expression $$v_b=\beta_b w_b,$$

where $v_b$ and $w_b$ are the respectively the bit velocity (or ROP—rate of penetration) and weight-on-bit (WOB), and $\beta_b$ is the cutting constant, independent of WOB (it may however depend on drilling fluid flow rate or bit rotation speed). However, above a certain WOB, for a fixed rotation speed, there will be little or no increase in bit velocity with WOB.

A similar expression applies for an under-reamer, i.e.

$$v_u=\beta_u w_u,$$

where the subscript u denotes the under-reamer. If the under-reamer and bit are rigidly connected (as in a conventional BHA), then their velocities must be equal. Then, denoting the sum of the WOBs of the drill bit and under-reamer by w, it follows that $$v=\left(\frac{1}{\beta_b}+\frac{1}{\beta_u}\right)^{-1}w$$

$$w_b=\frac{\beta_u}{\beta_b+\beta_u}w$$

$$w_u=\frac{\beta_b}{\beta_b+\beta_u}w.$$

$\beta_b$ and $\beta_u$ are inversely proportional to the respective bit area (the bigger the bit, for the same weight, the slower it cuts). Taking, as an example, an 8.75 inch diameter drill bit and an under-reamer following the drill bit and opening the initial bore hole to a diameter of 9.5 inches, the respective bit areas of the drill bit and under-reamer are about 60 square inches and about 10.75 square inches. Whence, if the drill bit and under-reamer are of similar construction, it can be seen that when the drill bit and under-reamer are drilling the same material, approximately 85% of the weight will be on the drill bit and 15% on the under-reamer.

Typically, the driller maintains constant total weight on the two bits through monitoring the surface apparent WOB.

Therefore, if the drill bit penetrates harder material, $\beta_b$ decreases but there will be very little effect on $w_b$ as it can increase by no more than 18%.

In contrast, if the under-reamer hits a much harder material, the effect on the under-reamer can be dramatic.

It is not unusual for cutting constants to increase by as much as a factor of ten, for instance between a shale and a carbonate stringer. In this case, two-thirds of the total weight would be on the under-reamer and only one-third on the drill bit, increasing $w_u$ by a factor of 4.5.

Particularly if this causes the under-reamer to surpass the $w_u$ for which there is little or no increase in bit velocity with $w_u$, the effect will be even more severe; $w_b$ will be that corresponding to the maximum speed the under-reamer can penetrate the hard material, and all the remaining weight will be on the under-reamer.

Although in the circumstances described above, and in most circumstances where an under-reamer is deployed, most of the weight is normally on the drill bit, there are situations where the weight is more evenly distributed—or even where most of the weight is on the under-reamer. In what follows where weight transfer from the drill bit to the under-reamer is referred to, unless explicit indication to the contrary is given, the same analysis and effects apply when weight transfers from the under-reamer to the drill bit.

With a conventional BHA, the time required for the weight to transfer from the drill bit to the under-reamer is usually very short, as the drillstring between the two cutting elements is very stiff. For example, taking a typical $w_b$ in the 10 klbf range and a separation distance between the drill bit and the under-reamer of a few tens of meters, the change in separation distance as the under-reamer meets harder material and most of the weight is removed from the bit and transferred to the under-reamer is only a few millimeters. At 120 feet/hour, the assembly is moving at about 1 cm/sec. Thus in this scenario the transfer of weight will occur in less than a second.

Surface measurements can give an indication that weight has moved from the drill bit to the under-reamer. In general, bit torque is proportional to WOB. However, for an under-reamer, the constant of proportionality will be much higher than for the drill bit, as all the cutters are located at large radial distances, increasing the torque induced by the same weight. Thus, while surface measurements provide weight and torque data with an offset applied (due e.g. to frictional losses in the well), measuring the correlation of changes in the weight and torque at the surface gives a reasonable estimation of the constant of proportionality. For example, when the under-reamer meets harder rock, this constant will rise sharply.

In some circumstances an indication that weight has moved from the drill bit to the under-reamer may be seen more directly. If the traveling block is still being advanced at a rate consistent with a higher rate-of-penetration, then the weight-on-bit will rise linearly when harder rock is encountered. If it is the drill bit that has met the harder rock, then the surface torque will also rise linearly. On the other hand, if it is the under-reamer that has met the harder rock, the surface torque will rise quadratically (the total weight grows linearly, and the proportion of it on the under-reamer also grows linearly, giving quadratic growth of the torque). Of course, if the weight is transferring from the under-reamer to the drill bit, the torque change will be quadratic, but it will be a quadratic reduction not an increase.

Unfortunately, without high speed telemetry, if the weight transfers to the under-reamer in less than a second, then neither of these methods gives the driller, or any automatic control mechanism at the surface, time to avert the excess weight loading the under-reamer.

Example BHA

FIG. 1 shows schematically an apparatus for drilling a bore hole 5. A drill string 11 penetrates the bore hole and terminates at the surface at the top drive 7 of a drilling rig. At the down-hole end of the drillstring, a BHA includes a drill bit 2 and an under-reamer 1 for drilling and enlarging the borehole. The under-reamer has a first diameter when tripping but unfolds to the nominal drilling diameter when in operation.

A compliant element 6 linking the drill bit to the under-reamer allows the drill bit and under-reamer to move relative to each other in the axial direction of the BHA.

The compliant element has a stroke length which defines the maximum and minimum axial spacing that can be produced between the drill bit and the under-reamer by this movement. It is biased towards the full stroke position, but the stroke length and compliance of the compliant element are selected such that with normal weight applied to the drill bit, the compliant element is shortened to about 15% of its stroke length (i.e. it moves the drill bit towards the under-reamer by a distance which is approximately equal to 85% of the stroke length). In this way, when weight is removed from the drill bit, the compliant element axially expands, thereby increasing the distance between the drill bit and the under-reamer. When the weight is reapplied, the compliant element returns to its original position. Also, if additional weight is applied to the drill bit, the compliant can shorten further within the remaining 15% of the stroke length.

A suitable compliant element may, for example, be based on a tool for maintaining wellbore penetration as described in U.S. Pat. No. 5,476,148 and Canadian patent nos. 2171178 and 2147063. These tools having a telescoping outer and inner members which are biased towards an open position by a plurality of springs.

A load cell sensor element 3, located between the compliant element and the drill bit, includes strain gauges which measure the weight and torque between the bit and the under-reamer. The measurement data is sent to surface via a transmitter 4, which may use e.g. mud-pulse or wired telemetry. At the surface, a strain gauge apparatus 10 on the deadline 9 of the rig measures the surface hookload. The surface torque is measured e.g. by measuring the current required to drive the top drive 7. Suitable load cells are described, for example, in U.S. Pat. Nos. 5,386,724 and 6,684,949.

The BHA may further include a rotary steerable motor 21 that in operation forces the drill bit 2 into a preferred direction, for example by extending pads against the formation in a repeated manner synchronized with the rotation of the drill string. Such rotary steerable systems are known as such. The rotary steerable system 21 is preferable located close to the drill bit 2, i.e. down-hole from the compliant element 6.

Introducing the compliant element 6 between the under-reamer and the drill bit provides at least three advantages.

Firstly, when the under-reamer meets harder material, the compliant element expands. The transfer of weight to the under-reamer is then much slower than when no such element is present. For example, with a compliant element having a one foot stroke, at 120 feet/hour the transfer of weight from the drill bit to the under-reamer will require at least 30 seconds. This gradual transfer of weight can provide the driller with enough in time to identify that it is the under-reamer that has met a harder rock, and not the bit, and to take appropriate action. The identification can be accomplished, as explained above, by looking for a gradual rise in the proportionality constant between the surface weight and torque, or looking for a quadratic rise in surface torque.

Secondly, the compliant element can by itself reduce shock-loads on the tool. For example, if the hard stringer is sufficiently thin, then the stringer may be drilled through before the compliant element has completely extended, keeping weight off the under-reamer without intervention from the surface. Also, the lengthening of the time over which weight transfers between the drill bit and the under-reamer virtually eliminates the axial shocks generated by the high-speed weight transfer process when no compliant element is present.

Both these advantages will tend to reduce bit wear and increase average ROP.

A third advantage pertains particularly to down-hole equipment such as rotary-steerable systems. As explained above, when weight transfers from the drill bit to the under-reamer, in general the torque acting on the BHA will increase. An increase in torque on the BHA that occurs faster than the rotational drive system (generally a top-drive or rotary-table) can respond will cause the rotation speed of the bit and under-reamer to drop, and then increase again when the response of the drive system reaches the BHA. This oscillation can persist in the system for a considerable time after the initial torque increase, and can even result in the BHA rotating backwards if the stress wave caused by the initial impulse and that generated by the rotational drive control system reinforce one another. The oscillations can damage down-hole equipment, especially the pads of rotary-steerable systems that press against the borehole wall and which can be damaged if counter-rotated against the wall. However, by using a compliant element according to the present invention, it is possible to reduce or eliminate the possibility of such damage.

Crucially important in determining whether such oscillations are initiated is the time over which the down-hole torque increases compared to the time it takes for shear wave generated by that torque increase to travel to the surface and the control system response to travel back down (the two-way time of the system). If the ratio of the torque increase time to the two-way time is small (less than one), oscillations will be generated. If it is long (greater than two), little oscillation will result.

Shear waves in steel travel at around 3000 m per second, and thus the two-way time for a drillstring (measured in seconds) is approximately the length of the drillstring (measured in meters) divided by 1500. Therefore, a 6000 m drillstring will have a two-way time of approximately 4 seconds. Without a compliant element between the under-reamer and the bit, at drilling speeds of around 30 meters/hour the time over which the torque increases will be a fraction of a second and thus torque oscillations will result. However, with a compliant element having a 20 cm stroke, at 30 meters per hour the torque increase time will be 24 seconds, and thus with this example, no significant torque oscillations will occur.

The BHA shown in FIG. 1 also has a load cell sensor element 3 for measuring the weight and torque distribution between the drill bit and the under-reamer. Without such a sensor element, the driller has to use indirect approaches to determining how much weight, or torque, is being applied to each of the drill bit and the under-reamer. However, with the sensor element, the weight on the bit is measured directly, and the weight on the under-reamer can be estimated by subtracting this from the surface weight-on-bit, with an allowance for friction in a highly deviated well. Similarly, the sensor element provides a direct measurement of the torque applied by the bit. The torque required to turn the pipe in the hole may be estimated either by measuring an off-bottom rotation torque, or, more accurately, by calculating a rotational friction coefficient from the off-bottom torque and calculating the side-forces from well surveys and then from these calculating the expected contribution from wellbore friction when weight is applied to the bits. Subtracting the wellbore frictional torque and the bit torque from the total surface torque then gives the under-reamer torque. Pressure measurements inside the drillstring, and in the annulus can also be used to measure the pressure drop through the bit and lower annulus, and thus distinguish between blockages or erosion in the drill bit nozzles, and blockages or erosion in the under-reamer nozzles.

If mud-pulse or low-frequency electromagnetic telemetry is used to transmit the down-hole measurements to the surface, the compliant element provides the time for the driller to receive the down-hole measurements, and to use them to confirm whether a preliminary identification of weight transfer, from surface measurements alone, is correct. However, preferably wired telemetry is used to transmit the measurements. In this case, the driller receives the measurements effectively instantaneously and at a high rate, and can use them to identify weight transfer as it occurs.

Using these down-hole measurements, the surface control system, whether manual or automated, can strive to maintain both the drill bit and the under-reamer within weight and torque limits, so as to achieve targets such as maximizing bit life, or ensuring that hole-section is drilled in a minimum number of bit-runs. Also, the measurement of $w_b$ and $w_u$ allows the respective cutting constants to be measured as drilling progresses. From this and the known separation between bit and under-reamer, the time at which the under-reamer will penetrate differing lithology can be anticipated and sudden increases in applied weight to the under-reamer averted rather than being remedied after the fact.

Based on the information from down-hole mechanical sensors, other means than weight adjustment may be employed at surface to balance the cutting of the drill bit and the under-reamer. For example, if there is a down-hole motor between the under-reamer and the bit, then the under-reamer rotation speed is determined solely by the rotation speed of the top-drive (or kelly), while the bit rotation speed is the sum of this and the rotation speed of the motor—which is determined by the drilling fluid flow rate. In order to increase the cutting efficiency of the under-reamer, while not turning the bit excessively fast, the pipe rotation speed may be increased while simultaneously reducing the flow rate.

When no down-hole motor is present, flow-rate and rotation speed may be used independently to influence the down-hole system. The cutting constants, $\beta_b$ and $\beta_u$, for the same rock in general depend on rotation speed, and on the flow rate and speed through the bit nozzles. If the dependencies of the constants differ, then by suitably adjusting rotation speed and/or flow rate, the cutting ability of either the under-reamer or the bit may be increased relative to the other.

Drilling Control in the Absence of Down-Hole Measurements

Even if no down-hole sensors are present, with the compliant element between the under-reamer and the bit, both the weight distribution between the drill bit and under-reamer and the cutting constants of the drill bit and the under-reamer may be inferred indirectly.

The apparent compliance of the drillstring depends on the proportion of the weight that is on the under-reamer. If the compliance of the drillstring above the under-reamer is $\lambda_u$ and the compliance of the drillstring between the under-reamer and the drill bit is $\lambda_b$ then the apparent compliance of the whole drillstring ($\lambda$) is given by $$\lambda = \lambda_u + \frac{w_b}{w_b + w_u}\lambda_b$$

where $w_b$ and $w_u$ are the weights on the drill bit and under-reamer respectively.

The above expression can be rearranged to give the weight ratio between the between the drill bit and the under-reamer in terms of $\lambda$, $\lambda_b$ and $\lambda_c$ $$\frac{w_u}{w_b} = \frac{\lambda_b - \lambda - \lambda_u}{\lambda - \lambda_u}.$$

The apparent compliance of the drillstring may be monitored by known methods e.g. as discussed in U.S. Pat. No. 4,843,875. If there are only drill collars or other standard components between the under-reamer and the drill bit, then the compliance $\lambda_b$ will be much smaller than $\lambda_u$. However, with a compliant element between the under-reamer and the drill bit, the two compliances will be comparable in size, and the apparent compliance can be used to monitor the relative weights on the drill bit and under-reamer.

In order to do this, as well as measuring the apparent compliance $\lambda$, we have to know the compliances $\lambda_u$ and $\lambda_b$. $\lambda_b$ can be determined from the specification of the compliant element, or by tests at the surface before running into hole (e.g. measuring the compression of the compliant element when a known force is applied). It does not change as drilling proceeds. $\lambda_u$, however, is more difficult to assess theoretically (field measurements in general do not agree accurately with theoretical predictions), and will increase as stands of pipe are added to the drillstring. Much of the discrepancy is believed to be due to compliance effects in the rig and hanging apparatus.

The sum of the two compliances may be measured before the under-reamer is activated (thus there is no weight on the under-reamer), and from this and the theoretical or measured $\lambda_b$, the compliance $\lambda_u$ can be determined at the start of drilling (e.g. when drilling out the casing shoe, before the under-reamer is activated). As drilling progresses, $\lambda_u$ may be increased by adding the theoretical compliance of each stand of pipe as it is added.

With a compliant element linking the drill bit and the under-reamer, when one of the drill bit and the under-reamer encounters harder material monitoring of the apparent compliance, together with the total weight transmitted through both bit and under-reamer (i.e. the normal surface WOB measurement) allows the driller to monitor independently both the weight on the under-reamer and the weight on bit. If W is the surface WOB (off-bottom hookload minus hookload), then $$W = w_u + w_b$$

and, writing $r = w_u/w_b$ as determined from the apparent compliance, the weights on under-reamer and bit are given by $$w_b = \frac{W}{1 + r}$$

-continued $$w_u = \frac{W}{\left(1 + \frac{1}{r}\right)}.$$

Using this information, and controlling the surface WOB, the driller may prevent overloading of both under-reamer and drill bit.

However, further information can be obtained by a drill-off test. During such a test, the drilling brake is locked, keeping the top of the drillstring fixed, and the hookload is measured over time.

The analysis of a drill-off test in the absence of an under-reamer is based on the following theory.

The bit velocity is assumed proportional to the WOB, $$v_b = \beta_b w_b,$$

and the total hookload H is given by $$H = W - w_b$$

where W is the weight of the drillstring.

With the top of the drillstring held constant, the bit velocity is related to the hookload by $$v_b = \lambda \frac{dH}{dt} = -\lambda \frac{dw_b}{dt}.$$

Solving for $w_b$:

$$w_b(t) = w_b(0)\exp\left(-\frac{\beta_b t}{\lambda}\right).$$

Fitting the observed change in hookload to an exponential function allows the coefficient $\beta_b/\lambda$ to be determined. If the compliance is known, then this enables the constant $\beta_b$ to be calculated.

If an under-reamer is added, then there is an additional relation at the underreamer:

$$v_u = \beta_u w_u,$$

and the equations relating the stretch in the drillstring to the force on it are:

$$v_u = -\lambda_u\left(\frac{dw_u}{dt} + \frac{dw_b}{dt}\right);$$

$$v_b - v_u = -\lambda_b \frac{dw_b}{dt}.$$

The solution to this set of equations involves the sum of two exponential decay terms. Whereby, writing $$w_b = W_b \exp(-st)$$

$$w_u = W_u \exp(-st)$$

then $$\begin{pmatrix} -s\lambda_u & (\beta_u - s\lambda_u) \\ (\beta_b - s\lambda_b) & -\beta_u \end{pmatrix}\begin{pmatrix} W_b \\ W_u \end{pmatrix} = 0.$$

The two solutions to this obey the quadratic equation $$s^2 - \left(\frac{\beta_b + \beta_u}{\lambda_b} + \frac{\beta_u}{\lambda_u}\right)s + \frac{\beta_u \beta_b}{\lambda_b \lambda_u} = 0,$$

the solutions to which are $$s_\pm = \frac{1}{2}\left(\frac{\beta_b + \beta_u}{\lambda_b} + \frac{\beta_u}{\lambda_u}\right) \pm \frac{1}{2}\sqrt{\left(\left(\frac{\beta_b}{\lambda_b} - \frac{\beta_u}{\lambda_u}\right)^2 + 4\frac{\beta_u^2}{\lambda_b \lambda_u}\right)}.$$

The two roots may be found from the observed change in the hookload during the drill-off test. The best fit of the change measured against time to the sum of two exponentials is found, the coefficients of the exponentials being the two roots $s_+$ and $s_-$. If the two compliances $\lambda_u$ and $\lambda_b$ are known, then the relationship between the roots and the cutting constants $\beta_u$ and $\beta_b$ can be inverted to calculate the cutting constants. These cutting constants may be compared with those expected for sharp bits and under-reamers when drilling the current lithology, or values obtained from offset wells, in order to monitor bit and under-reamer wear, or to diagnose other problems such as bit-balling.

Furthermore, from the cutting constants, the equilibrium ratio of weight on bit to weight on under-reamer may be recalculated, since if both drill bit and under-reamer are moving at the same velocity it follows that $$\frac{\beta_b}{\beta_u} = \frac{w_u}{w_b}.$$

Therefore, although without down-hole sensors the driller does not have access to a direct measure of the weight on the drill bit, the approaches outlined above can be used to infer the weights on the drill bit and under-reamer, the cutting constants of the drill bit and under-reamer, and also the equilibrium weight ratio between the drill bit and under-reamer.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

All the references mentioned above are hereby incorporated by reference.

The invention claimed is:

1. A bottom hole assembly comprising:

a drill bit and an under-reamer on the up-hole side of the drill bit, a compliant element linking the drill bit to the under-reamer, the compliant element allowing displacement of the drill bit relative to the under-reamer in the axial direction of the assembly, and a rotary steerable system located in the drillstring down-hole from the compliant element.

2. A bottom hole assembly according to claim 1, wherein the compliant element is adapted to allow at least 10 cm of relative displacement.

3. A bottom hole assembly according to claim 1, wherein the compliant element has a compliance in the range 0.5 to 10 μm/Newton.

4. A bottom hole assembly according to claim 1, wherein the compliant element is biased towards a fully extended position which produces a maximum relative displacement between the drill bit and the under-reamer.

5. A bottom hole assembly according to claim 1, wherein the compliant element comprises a spring to generate the bias.

6. A bottom hole assembly according to claim 1, further having a sensor element which is arranged to measure the weight-on-bit and/or the applied torque of the drill bit, and a transmitter for transmitting the weight-on-bit and/or applied torque measurements to the surface.

7. A method of controlling an under-reaming drilling operation, comprising the steps of:

drilling a well with the bottom hole assembly having a compliant element linking the drill bit to the under-reamer, the compliant element allowing displacement of the drill bit relative to the under-reamer in the axial direction of the assembly, wherein the compliant element is located down-hole of the under-reamer;

monitoring the surface torque applied to the drill string; and controlling the drilling operation to avoid overloading the under-reamer or the drill bit when the surface torque indicates that weight is transferring between the drill bit and the under-reamer.

8. A method according to claim 7, further comprising the steps of:

monitoring the surface hookload, and correlating the surface hookload with the surface torque;

the drilling operation being controlled to avoid overloading the under-reamer or the drill bit when the correlation of the surface hookload with the surface torque indicates that weight is transferring between the drill bit and the under-reamer.

9. A method of controlling an under-reaming drilling operation, comprising the steps of:

drilling a well with the bottom hole assembly having a compliant element linking the drill bit to the under-reamer, the compliant element allowing displacement of the drill bit relative to the under-reamer in the axial direction of the assembly, wherein the compliant element is located below the under-reamer;

measuring the weight-on-bit and/or the applied torque of the drill bit using the sensor element; and controlling the drilling operation to avoid overloading the under-reamer or drill bit when the measured weight-on-bit and/or applied torque indicates that weight is transferring between the drill bit and the under-reamer.

10. A method of controlling an under-reaming drilling operation, comprising the steps of:

drilling a well with the bottom hole assembly having a compliant element linking the drill bit to the under-reamer, the compliant element allowing displacement of the drill bit relative to the under-reamer in the axial direction of the assembly, wherein the compliant element is located below the under-reamer;

monitoring the apparent compliance of the drillstring using surface measurements;

inferring from the apparent compliance the weight ratio between the under-reamer and the drill bit; and controlling the drilling operation to avoid overloading the under-reamer or drill bit when the weight ratio indicates that weight is transferring between the drill bit and the under-reamer.

11. A method of monitoring cutting constants during an under-reaming drilling operation, the method comprising the steps of:

drilling a well with the bottom hole assembly having a compliant element linking the drill bit to the under-reamer, the compliant element allowing displacement of the drill bit relative to the under-reamer in the axial direction of the assembly, wherein the compliant element is located below the under-reamer;

performing a drill-off test and measuring the hookload against time during the test;

inferring from the measured hookload against time the cutting constants of the drill bit and the under-reamer; and using the cutting constants to manage the under-reaming drilling operation.

* * * * *